United States Patent [19]

Bornefeld et al.

[11] 4,266,373

[45] May 12, 1981

[54] APPARATUS FOR DEBURRING EDGES

[75] Inventors: Horst Bornefeld, Burscheid; Gerd Comberg; Werner Engel, both of Leverkusen; Johannes Neyer, Odenthal-Erberich, all of Fed. Rep. of Germany

[73] Assignee: Goetze AG, Burscheid, Fed. Rep. of Germany

[21] Appl. No.: 88,062

[22] Filed: Oct. 24, 1979

[30] Foreign Application Priority Data

Oct. 30, 1978 [DE] Fed. Rep. of Germany ..... 2847192

[51] Int. Cl.[3] ..... B24B 9/00

[52] U.S. Cl. ..... 51/99; 51/105 R; 51/290

[58] Field of Search ..... 51/47, 90, 99, 103 R, 51/103 C, 104, 105 R, 106 R, 126, 165.93, 241 S, 290

[56] References Cited

U.S. PATENT DOCUMENTS

| | | | |
|---|---|---|---|
| 540,499 | 6/1895 | Koegel | 51/99 X |
| 2,442,042 | 5/1948 | Hamilton | 51/99 |
| 3,738,064 | 6/1973 | Szyferblatt | 51/99 X |
| 4,075,792 | 2/1978 | Schreiber | 51/99 X |
| 4,135,890 | 1/1979 | Billault | 51/124 L |

FOREIGN PATENT DOCUMENTS

| | | | |
|---|---|---|---|
| 1752149 | 5/1971 | Fed. Rep. of Germany . | |
| 2327439 | 12/1973 | Fed. Rep. of Germany | 51/99 |
| 2514267 | 10/1976 | Fed. Rep. of Germany | 51/105 R |
| 7708223 | 2/1977 | Fed. Rep. of Germany . | |
| 2711612 | 9/1978 | Fed. Rep. of Germany | 51/290 |
| 133913 | 1/1979 | Fed. Rep. of Germany | 51/99 |
| 1242040 | 8/1971 | United Kingdom . | |

*Primary Examiner*—Gary L. Smith
*Assistant Examiner*—Robert P. Olszewski
*Attorney, Agent, or Firm*—Spencer & Kaye

[57] ABSTRACT

An apparatus for deburring a circumferential edge of a workpiece, including a rotary deburring tool having an axis of rotation which is substantially parallel to the tangent belonging to the workpiece edge at a location contacted by the deburring tool.

17 Claims, 1 Drawing Figure

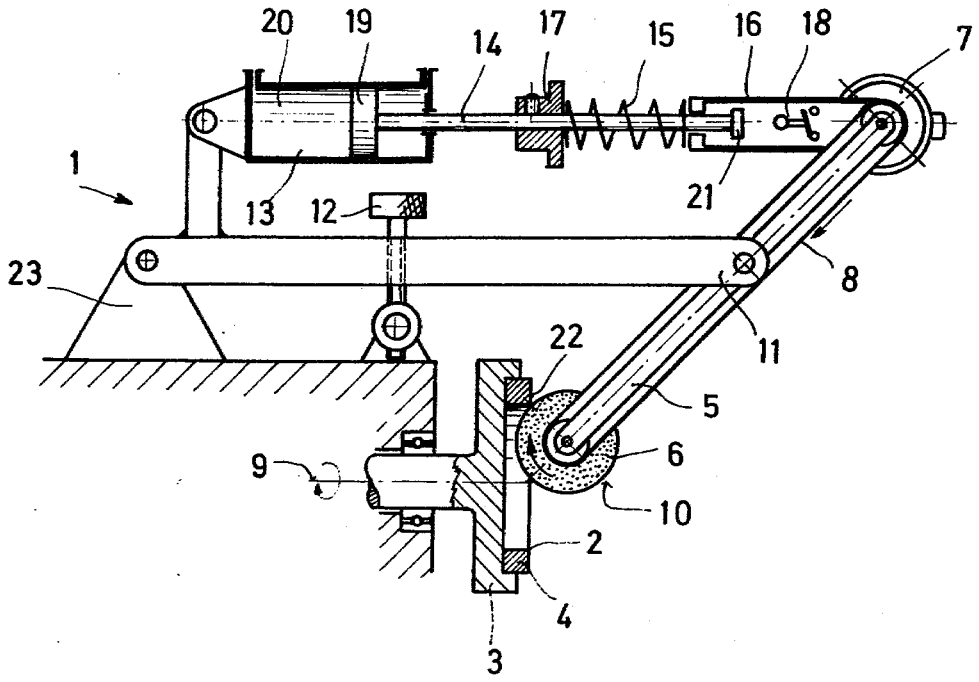
20
19
14
17
15
16
18
7
1
13
12
21
23
8
11
22
5
6
9
10
2
4
3

APPARATUS FOR DEBURRING EDGES

BACKGROUND OF THE INVENTION

This invention relates to an apparatus for removing burrs from edges of workpieces, particularly from edges of circumferential surfaces of piston rings.

During the machining of the flank faces of piston rings by turning, grinding or other processes involving mechanical material removal, burrs appear on the non-chamfered edges. For removing these burrs there have been known technical solutions such as brushing with rotary brushes, circumferential grinding with mounted points or chamfering by means of turning tools.

In particular, German Utility Patent Model (Gebrauchsmuster) No. 7,708,223 discloses a grinding apparatus for deburring axial surfaces of piston rings, wherein the grinding tool comprises a metal wire brush having a driven brush body rotatable about an axis and wherein the wires are substantially radially oriented. The brush is supported on a carriage in such a manner that upon carriage feed the circumferential brush surface defined by the free ends of the brush wires sweeps over the piston ring edge which is to be deburred.

Grinding apparatuses of the above-outlined type, particularly when used to work on piston rings made of ductile material are disadvantageous in that the rings are insufficiently deburred or the burr is simply pressed flat instead of being removed. In particular, it may occur that during the deburring non-uniform chamfers are obtained dependent upon the differences in the wall thickness; such a result has disadvantageous effects on the operation of the piston ring.

SUMMARY OF THE INVENTION

It is an object of the invention to provide an improved apparatus which removes burrs in such a manner that only slight chamfers or rounded edges if any, are formed, particularly when the workpieces are steel piston rings having non-uniform radial wall thicknesses.

This object and others to become apparent as the specification progresses, are accomplished by the invention, according to which, briefly stated, the rotary arms of the deburring tool is oriented substantially parallel to the tangent belonging to that point of the workpiece edge to be deburred which constitutes the contact point between edge and tool.

The invention provides that the deburring apparatus may be arranged at any desired angular position with respect to the axis of the workpiece without thereby changing the above-noted parallelism. An angle between 0° and 90° is preferred. In principle, it is feasible to arrange the deburring apparatus in such a manner that the deburring tool is located eccentrically with respect to the workpiece axis in which case the above-noted relationship of parallelism, to be sure, changes, but the deburring effect remains the same.

According to a further advantageous feature of the invention, the deburring tool is a grinding disc which has an elastically damping binder; that is, the individual grinding particles are bound, for example, in a rubber mixture. In principle, it is feasible to use rotary brushes, polishing discs or the like. Further, the direction of grinding is substantially radial to the edge to be deburred, so that the grinding tool, during the deburring operation, does not assume the profile of the workpiece to be deburred. This advantage makes it unnecessary to readjust the grinding tool; all that is necessary is to replace the grinding tool after a predetermined wear.

According to a further feature of the invention, the grinding tool is rotatably supported on a pivotal lever and can be applied to the circumferential edge of the workpiece to be deburred with an adjustable and substantially constant force at a predetermined angle. The apparatus further has a linear motor connected with the lever for effecting the pivotal motions thereof. Preferably, the tool lever is a two-armed lever and has a drive for the grinding tool at a side oriented away from the grinding tool. The relocation of the tool drive from that end of the lever which is oriented towards the workpiece is, among others, advantageous in that the grinding tool can be better positioned at the inner circumferential edges of workpieces which have a relatively small diameter.

The tool drive may be an electromotor or a pneumatic motor. The force transmission from the drive to the grinding tool is preferably effected by an endless belt. The inclination of the dual lever to the axis of the workpiece should be approximately 45° in the working position, since at such an angle the position of the grinding tool is substantially maintained throughout the zone exposed to wear, that is, no adjustment of the grinding tool is necessary.

Further, the dual lever is pivotally supported at a defined distance from the axis of the grinding tool at the free end of pivotal guiding lever. Preferably, the pivotal axes of the dual lever and the grinding lever are parallel to one another. The radial distance of the workpiece axis to the guide lever is adjustable by means of a set screw arranged between the two ends of the guide lever. By supporting the dual lever in a pivotal guide lever and also, by means of the above-noted adjustability, workpieces of different dimensions may be deburred by one and the same apparatus.

Further, the dual lever is coupled at that end with the drive of the linear motor which is remote from the lever end carrying the grinding tool. The linear motor is preferably formed of a piston-and-cylinder unit, but the same effect can be achieved in principle with an electromotor and a cam disc. Between the dual lever and the linear motor there is provided a force-dependent length equalizing device which is formed of the piston rod of the piston-and-cylinder unit. The piston rod is displaceable into a guide body against the force of a spring which surrounds the piston rod and engages the guide body at one end and a stop affixed to the piston rod at the other end. Preferably, the stop is axially displaceable on the piston rod so that a desired spring force can be set.

According to a further feature of the invention, a limit switch is provided in the guide body. The limit switch which is actuated by the outer end of the piston rod serves for signalling the completion of the deburring process. For simplifying the deburring apparatus, the piston rod and the guide lever are arranged approximately parallel to the workpiece axis. This results in a compact structure of the apparatus. Further, the speed of the linear motor can be controlled so that dependent upon the particular material to be machined, the feeding speed of the grinding tool as well as the period of grinding can be controlled.

In accordance with a further feature of the invention, the grinding tool such as a grinding disc, has abrasive particles which are bound in an elastic layer, preferably a rubber layer. The damping effect of the elastic grinding disc, the controllable feeding speed thereof, the settable grinding pressure which is to be maintained constant as well as the adjustability of the actual grinding period in a coordinated manner lead to an optimal effect for preventing chatter marks and for ensuring an accurate control of the material removal during the deburring process. During the deburring process the grinding tool may be slightly in an eccentric position or may have axially undulating circumferential edges since the feed motion of the grinding tool is controllable solely by the adjustable pressing force. This result can be enhanced by a weight-equalization by providing the tool drive on that side of the dual lever which is opposite the grinding tool.

BRIEF DESCRIPTION OF THE DRAWING

The sole FIGURE is a schematic, partially sectional, side elevational view of a preferred embodiment of the invention.

DESCRIPTION OF THE PREFERRED EMBODIMENT

Turning now to the FIGURE, there is shown, in its working position, an apparatus generally indicated at 1 for the deburring of an inner circumferential edge 2 of a workpiece, such as a piston ring 4 clamped into a chuck 3. The apparatus 1 has a two-arm tool lever (dual lever) 5 supporting, at its end adjacent the workpiece 4, a grinding disc 6 in which the abrasive particles are bound in an elastic binder. At the free end of the dual lever 5 opposite from the grinding disc 6, an electromotor 7 is arranged which constitutes the drive for the grinding disc 6. The force transmission from the drive 7 to the grinding disc 6 is effected by an endless flat belt 8. In the working position, the inclination of the dual lever 5 to the axis 9 of the workpiece is approximately 45°. The rotary axis of the grinding disc 6 is so oriented according to the invention that it extends parallel to a tangent belonging to that point on the workpiece edge 2 which constitutes the location of contact between the grinding disc 6 and the edge 2. Stated differently, the grinding disc axis is parallel to the tangent belonging to a certain point on an imaginary circle which lies in a plane perpendicular to the chuck axis (and thus the workpiece axis) 9 and which coincides with the workpiece edge 2. The point, in turn, is defined by the location where the outer peripheral face of the grinding disc 6 and the imaginary circle meet.

The dual lever 5 is, at a predetermined distance from the grinding disc axis 10, rotatably held on a guide lever 11 which is pivotally held by a bracket 23. The distance of the guide lever 11 from the axis 9 of the workpiece can be varied by means of a set screw 12. At its end remote from the grinding disc 6, the dual lever 5 is coupled with a piston-and-cylinder unit 13. Between the dual lever 5 and the piston-and-cylinder unit 13 there is provided a compression spring 15 surrounding the piston rod 14 of the unit 13. The piston rod 14 is displaceable into a guide body 16 against the force of the spring 15. The spring 15 engages the guide body 16 at one end, while, at its other end, it is in contact with a stop 17 axially adjustably secured to the piston rod 14. In the guide body 16 there is provided a limit switch 18 which can be actuated by the terminus 21 of the piston rod 14 to thus signal the completion of the grinding process. In order to ensure that the apparatus 1 has a small, compact structure, the piston rod 14 and the guide lever 11 are arranged parallel to the workpiece axis 9.

In the description which follows the above-described apparatus will be set forth.

After the flank face 22 of the piston ring 4 has been machined, the piston 19 of the cylinder 20 is exposed to fluid pressure in the unit 13. As a result, the piston rod 14 moves out of the cylinder of the unit 13 and pivots the dual lever 5 against the pressure of the spring 15 about its articulation with the guide lever 11 towards piston ring 4, where the grinding disc 6 engages the inner circumferential edge 2 with predetermined speed. The grinding disc 6 thus engages with an approximately constant force the inner circumferential edge 2 of the piston ring 4. Both the piston ring 4 and the grinding disc 6 are rotating. After the grinding disc 6 has been stopped (for example, by de-energizing the motor 7), the piston 19 is continued to be exposed to fluid pressure and thus the end 21 of the piston rod 14 is pressed against the limit switch 18 provided in the guide body 16 to signal the completion of the grinding process.

It will be understood that the above description of the present invention is susceptible to various modifications, changes and adaptations, and the same are intended to be comprehended within the meaning and range of equivalents of the appended claims.

What is claimed is:

1. In an apparatus for deburring a circumferential edge of a workpiece, including a rotary deburring tool having an axis of rotation; the tool and the workpiece edge defining a location of contact during the deburring of the edge; the improvement wherein said axis is substantially parallel to the tangent belonging to the workpiece edge at said location; further comprising (a) a tool lever having an end carrying said rotary deburring tool;

(b) means for pivotally supporting said tool lever and including a guide lever being articulated to said tool lever at a predetermined distance from said end thereof; said guide lever being pivotally supported at a location spaced from the articulation with said tool lever;

(c) a linear motor coupled to said tool lever for pivotally urging said tool lever toward the workpiece edge at a predetermined angle; and (d) force-equalizing means coupled to said linear motor and said tool lever for setting and maintaining substantially constant the tool feeding force derived from said linear motor.

2. An apparatus as defined in claim 1, wherein the direction of deburring effected by said tool is substantially radial to said edge.

3. An apparatus as defined in claim 1, further comprising chuck means for clamping the workpiece; said chuck means and the workpiece having coinciding axes; said tool lever having a working position in which it has an inclination of approximately 45° with respect to the axis of said chuck means.

4. An apparatus as defined in claim 1, wherein said deburring tool is a grinding disc.

5. An apparatus as defined in claim 4, wherein said grinding disc comprises abrasive particles and an elastically dampening binder binding said abrasive particles.

6. An apparatus as defined in claim 1, wherein said tool lever is formed as a two-armed lever.

7. An apparatus as defined in claim 1, wherein said linear motor comprises a piston-and-cylinder unit.

8. An apparatus as defined in claim 1, wherein the speed of said linear motor is controllable.

9. An apparatus as defined in claim 1, wherein said tool lever has opposite first and second ends; said deburring tool being mounted on said first end; further comprising a tool drive motor mounted on said second end and force-transmitting means coupling said tool drive motor with said deburring tool.

10. An apparatus as defined in claim 9, wherein said force-transmitting means is an endless belt.

11. An apparatus as defined in claim 1, further comprising chuck means for clamping the workpiece; said chuck means having a rotary axis; further wherein said linear motor has an output rod; said output rod and said guide lever extending at least approximately parallel to said axis of said chuck means.

12. An apparatus as defined in claim 1, wherein said tool lever and said guide lever have respective pivotal axes extending parallel to one another.

13. An apparatus as defined in claim 1, further comprising chuck means for clamping the workpiece; and adjusting means for varying the position of said guide lever with respect to said chuck means.

14. An apparatus as defined in claim 13, wherein said adjusting means comprises a setscrew arranged at a location between opposite ends of said guide lever.

15. In an apparatus for deburring a circumferential edge of a workpiece, including a rotary deburring tool having an axis of rotation; the tool and the workpiece edge defining a location of contact during the deburring of the edge; the improvement wherein said axis is substantially parallel to the tangent belonging to the workpiece edge at said location; further comprising (a) a tool lever carrying said rotary deburring tool;
(b) means for pivotally supporting said tool lever;
(c) a linear motor coupled to said tool lever for pivotally urging said tool lever toward the workpiece edge at a predetermined angle; said linear motor including a longitudinally displaceable output rod;
(d) force-equalizing means coupled to said linear motor and said tool lever for setting and maintaining substantially constant the tool feeding force derived from said linear motor;
(e) a force-dependent length equalizing means connected between said linear motor and said tool lever; said length equalizing means comprising a hollow guide body mounted on said tool lever and receiving an end portion of said output rod;
(f) spring means resiliently resisting the penetration of said output rod into said guide body; and
(g) a limit switch arranged in said guide body for being actuated by said end portion of said output rod for generating a signal upon the completion of a deburring operation.

16. An apparatus as defined in claim 15, wherein said spring means comprises a compression spring surrounding said output rod; and further wherein said length equalizing means comprises a stop mounted on said output rod externally of said guide body; said compression spring engaging said stop and said guide body.

17. An apparatus as defined in claim 16, further comprising means for adjusting said stop along said output rod.

* * * * *